US007578489B1

(12) United States Patent
Lee

(10) Patent No.: US 7,578,489 B1
(45) Date of Patent: Aug. 25, 2009

(54) QUICK RELEASE PRESS MOUNT

(75) Inventor: Richard J. Lee, Hartford, WI (US)

(73) Assignee: Lee Precision, Inc., Hartford, WI (US)

( * ) Notice: Subject to any disclaimer, the term of this patent is extended or adjusted under 35 U.S.C. 154(b) by 0 days.

(21) Appl. No.: 12/209,602

(22) Filed: Sep. 12, 2008

(51) Int. Cl.
*A47B 96/00* (2006.01)

(52) U.S. Cl. ..... 248/223.41; 248/224.61

(58) Field of Classification Search ..... 248/223.31, 248/223.41, 224.51, 224.61, 224.7, 674–678, 248/680; 269/32, 24, 27
See application file for complete search history.

(56) References Cited

U.S. PATENT DOCUMENTS 2,124,541 A * 7/1938 Cassey ..... 248/223.41
3,576,303 A * 4/1971 Matson ..... 248/672
4,324,377 A * 4/1982 Jones et al. ..... 248/37.6
4,815,734 A * 3/1989 Verhulst ..... 473/488
5,707,033 A * 1/1998 Holt et al. ..... 248/225.11
5,857,658 A 1/1999 Niemiec
7,191,990 B2 3/2007 Hutter, III

* cited by examiner

*Primary Examiner*—Gwendolyn Baxter
(74) *Attorney, Agent, or Firm*—Donald J. Ersler

(57) ABSTRACT

A quick release press mount includes a first retainer clip, a second retainer clip, a clip base and a plurality of clip fasteners. The clip base includes a plurality of tapped holes. Fasteners are inserted through the first and second retainer clips and secured in the plurality of tapped holes. A press base has a shape that is sized to be received by a space created between the first and second retainer clips. The press base is attached to a bottom of a press or the like. A plurality of openings are formed through the clip base for attachment to a base or the like with a plurality of fasteners. A second embodiment of the quick release press mount includes a clip base with an extended height. A third embodiment of the quick release press mount eliminates the clip base.

18 Claims, 4 Drawing Sheets

FIG. 6
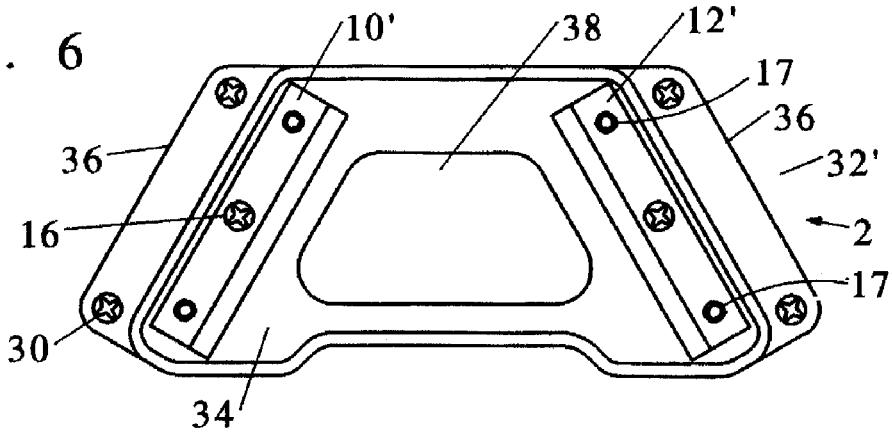
FIG. 7
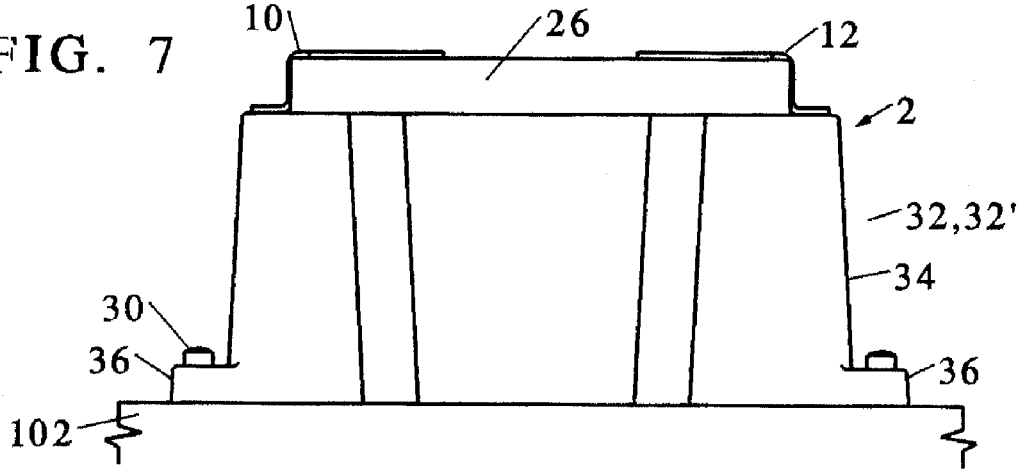
FIG. 8
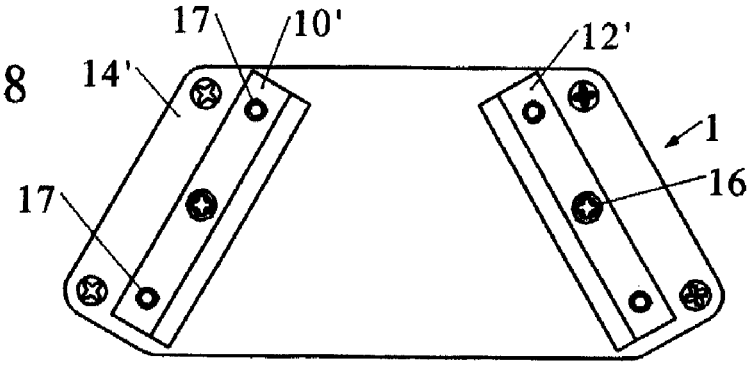
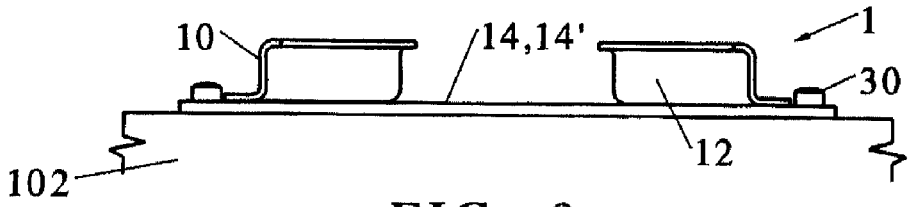
FIG. 9

QUICK RELEASE PRESS MOUNT

BACKGROUND OF THE INVENTION

1. Field of the Invention

The present invention relates generally to retaining different presses on a bench and more specifically to a quick release press mount, which allows a press or the like to be retained by turning at least two fasteners.

2. Discussion of the Prior Art

U.S. Pat. No. 5,857,658 to Niemiec discloses a clamping bracket. The Niemiec patent includes a clamping bracket for clamping an object to a structure. The clamping bracket includes an opening for receiving an object, two sides and an end. U.S. Pat. No. 7,191,990 to Hutter, III discloses an adjustable mounting bracket. The Hutter patent includes an adjustable mounting bracket for secure mounting as by adhesive attachment onto an exposed edge of a substrate.

Accordingly, there is a clearly felt need in the art for a quick release press mount, which allows different presses or bench mounted tools to be secured to a bench or the like by turning at least two fasteners.

SUMMARY OF THE INVENTION

The present invention provides a quick release press mount, which allows a press or other bench mounted tool to be secured to or removed from a bench by turning at least two fasteners. The quick release press mount includes a first retainer clip, a second retainer clip, a clip base and at least two clip fasteners. Each retainer clip includes a fastening leg, a clamping leg and a retention leg. The fastening leg extends outward from one end of the retention leg and the clamping leg extends outward from the other end of the retention leg in an opposite direction. The clip base includes at least two tapped holes.

At least one opening is formed through the first and second retainer clips to mate with the at least two tapped holes in the clip base. A fastener is inserted through each opening in the first and second retainer clips and secured in the at least two tapped holes. A press base has a shape that is sized to be received by the space created between the first and second retainer clips. The press base is attached to a bottom of a press or the like. A plurality of openings or tapped holes are formed in the clip base for attachment to a bench or the like with a plurality of fasteners.

A second embodiment of the quick release press mount includes a clip base with an extended height. A third embodiment of the quick release press mount eliminates the clip base. The first and second retainer clips are screwed directly into a bench or the like. In all embodiments, the clip fasteners are loosened (without removing the clip fasteners from the tapped holes); the press base (while attached to the press) is inserted into the first and second retainer clips; and the clip fasteners are tightened.

Accordingly, it is an object of the present invention to provide a quick release press retainer, which allows different presses to be secured to a bench or the like by turning at least two fasteners.

These and additional objects, advantages, features and benefits of the present invention will become apparent from the following specification.

BRIEF DESCRIPTION OF THE DRAWINGS

FIG. 6 is a top view of a second embodiment of a quick release press mount with a single clip fastener and at least one dowel retaining each retainer clip in accordance with the present invention.

FIG. 7 is a front view of a second embodiment of a quick release press mount with a press base inserted therein in accordance with the present invention.

FIG. 8 is a top view of a quick release press mount with a single clip fastener and at least one dowel retaining each retainer clip in accordance with the present invention.

FIG. 9 is a front view of a quick release press mount in accordance with the present invention.

DETAILED DESCRIPTION OF THE PREFERRED EMBODIMENTS

Figure 1:
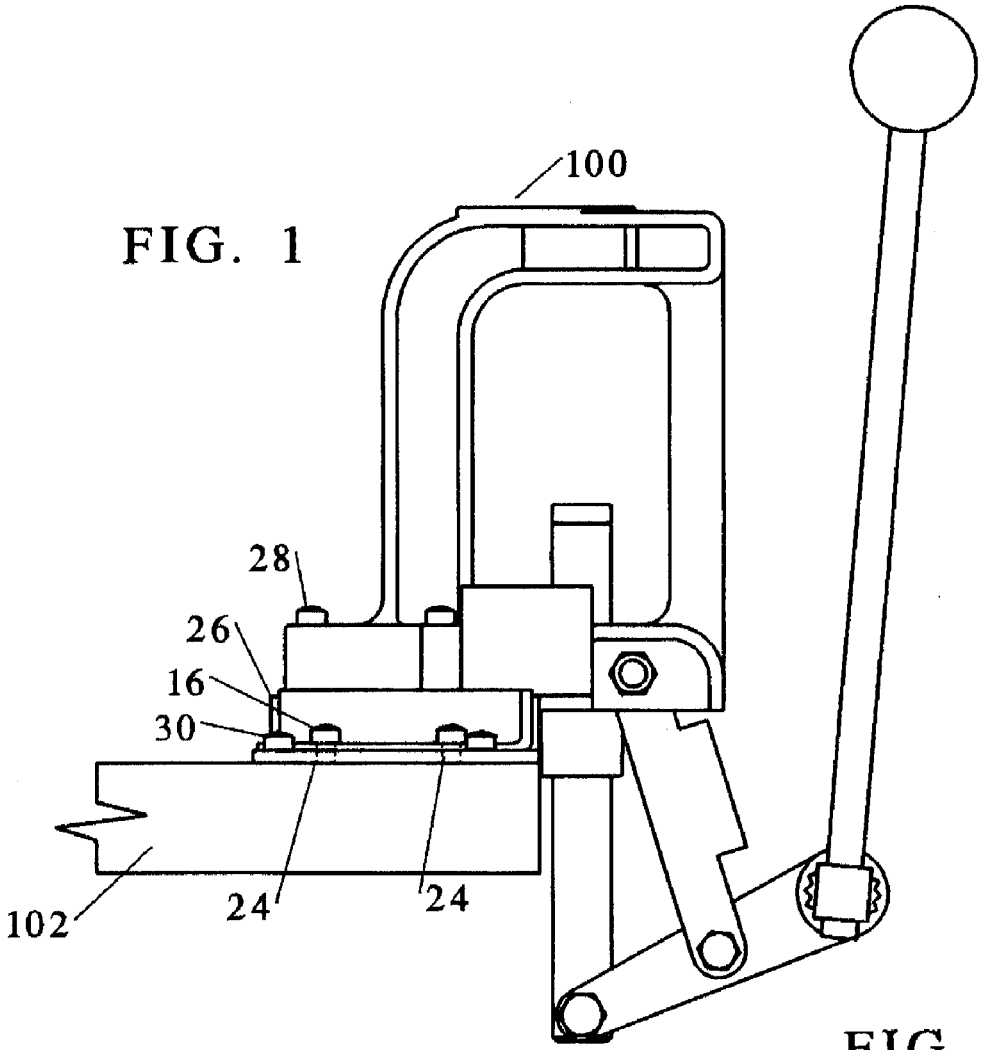
FIG. 1 is a side view of a press retained on a work surface with a quick release press mount in accordance with the present invention.
Figure 3:
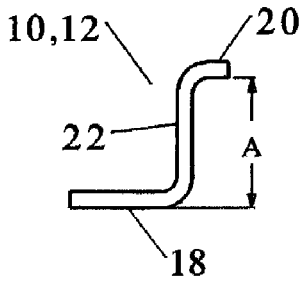
FIG. 3 is an enlarged end view of a first or second clip retainer of a quick release press mount in accordance with the present invention.
Figure 3:
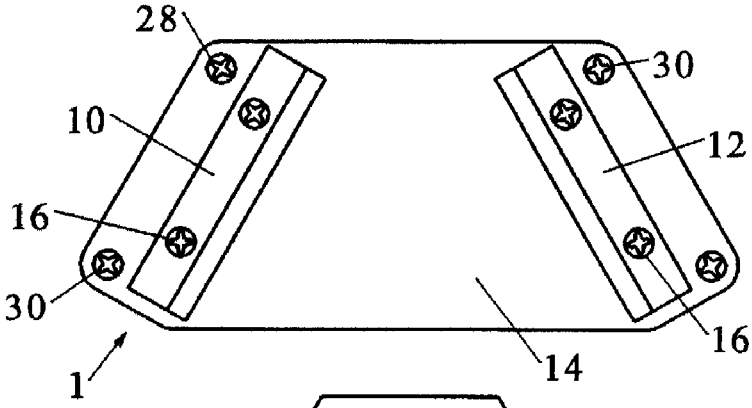
Figure 2:
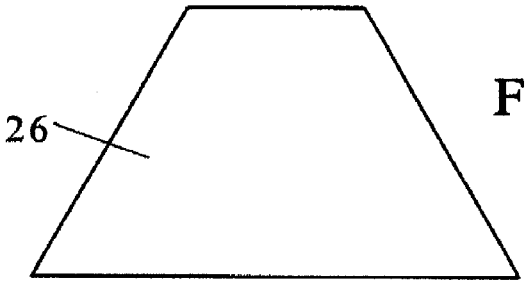
FIG. 2 is a top view of a quick release press mount with a press base ready for insertion therein in accordance with the present invention.
Figure 4:
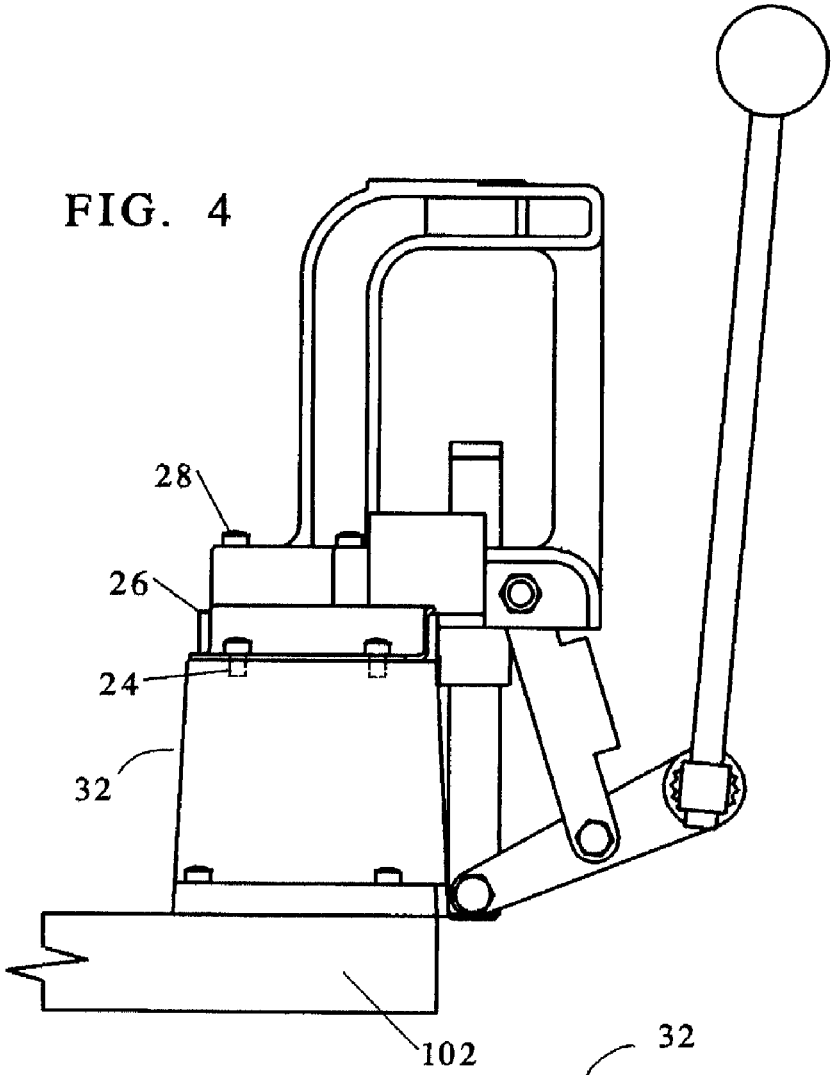
FIG. 4 is a side view of a press retained on a work surface with a second embodiment of a quick release press mount in accordance with the present invention.
Figure 4:
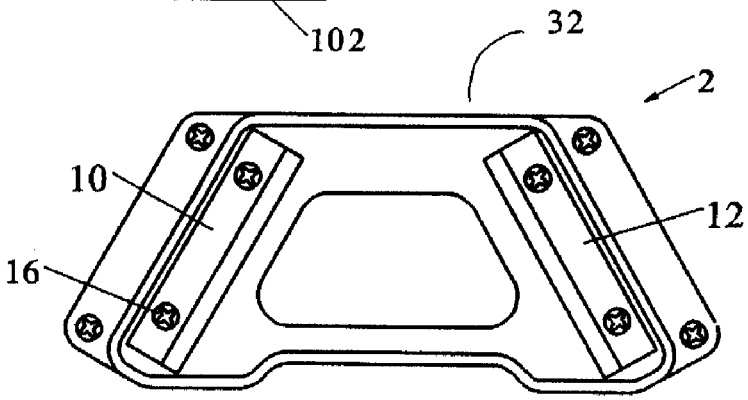
Figure 5:
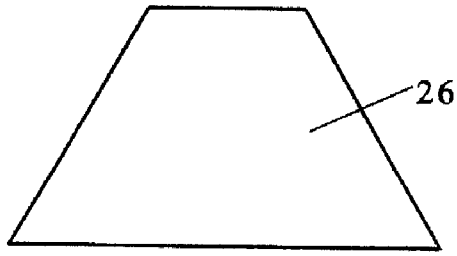
FIG. 5 is a top view of a second embodiment of a quick release press mount with a press base ready for insertion therein in accordance with the present invention.
Figure 10:
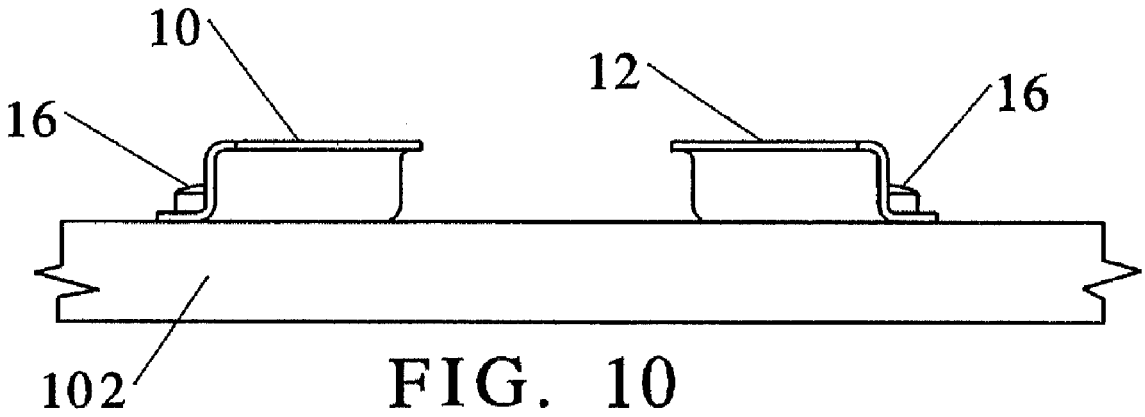
FIG. 10 is a front view of first and second retainer clips of a quick release press mount attached directly to a bench in accordance with the present invention.

With reference now to the drawings, and particularly to FIG. 1, there is shown a side view of a press 100 retained in a quick release press mount 1. With reference to FIGS. 2-3 and 8-9, the quick release press mount 1 includes a first retainer clip 10, a second retainer clip 12, a clip base 14 and a plurality of clip fasteners 16. Each retainer clip includes a fastening leg 18, a clamping leg 20 and a retention leg 22. The fastening leg 18 extends outward from one end of the retention leg 22 and the clamping leg 20 extends outward from the other end of the retention leg 22 in an opposite direction. The clip base 14 includes two sets of tapped holes 24. The tapped holes 24 are sized to threadably receive the plurality of clip fasteners 16.

At least one opening is formed through the first and second retainer clips to mate with the at least two tapped holes 24 in the clip base 14. A single clip fastener 16 is inserted through each opening in the first and second retainer clips and threaded into the tapped holes 24. With reference to FIG. 8, a single clip fastener 16 and at least one dowel 17 are used to retain a first retainer clip 10' and a second retainer clip 12'. At least two dowel holes are formed in a clip base 14' to receive the at least one dowel 17. The at least one dowel 17 prevents pivoting of the first retainer clip 10' and the second retainer clip 12'.

A press base 26 preferably has a trapezoidal shape that is sized to be received by a trapezoidal space created between the first and second retainer clips. However, the press base 26 may also have other suitable shapes, such as a triangle or hexagon. A height of the dimension "A" (inside height) from a bottom of the fastening leg 18 to a bottom of the clamping leg 20 is slightly less than a thickness of the press base 26. The following dimension is given by example and not by limitation, satisfactory results have been found when dimension "A" is 0.03 inches less than the thickness of the press base 26, but other dimensions may also be used. The press base 26 is attached to a bottom of the press 100 with a plurality of press fasteners 28 or the like. A plurality of openings are formed through the clip base 14, 14' for attachment to a work bench 102 or the like with a plurality of retention fasteners 30.

With reference to FIGS. 4-7, a second embodiment of the quick release press mount 2 includes the first retainer clip 10, the second retainer clip 12, a clip base 32 and the plurality of clip fasteners 16. The clip base 32 includes a riser block 34, a pair of opposing flanges 36 and an opening 38. The riser block 34 preferably has a substantially trapezoidal shape, but other suitable shapes may also be used. The opening 38 is formed through a height of the riser block 34. At least two tapped holes 24 are formed in a top of the riser block 34. The tapped holes 24 are sized to threadably receive the plurality of clip fasteners 16. With reference to FIG. 6, a single clip fastener 16 and at least one dowel 17 is used to retain the first retainer clip 10' and the second retainer clip 12'. At least two dowel holes would be formed in a clip base 32' to receive the dowels 17. The at least one dowel 17 prevents pivoting of the first retainer clip 10' and the second retainer clip 12'.

The single opening formed through the first and second retainer clips mate with the two sets of tapped holes 24 in the clip base 32. The press base 26 preferably has a trapezoidal shape that is sized to be received by a trapezoidal space created between the first and second retainer clips. However, the press base 26 may have other shapes, such as a triangle or hexagon. A plurality of openings are formed through the two flanges 36 for attachment to a work bench 102 or the like with the plurality of retention fasteners 30.

A third embodiment of the quick release press mount eliminates the clip bases 14, 14', 32 and 32'. The first and second retainer clips are screwed directly into a support surface, such as the bench 102. In all embodiments, the clip fasteners 16 are loosened (without removing the clip fasteners 16 from the tapped holes 24) with a screw driver, allen wrench or the like; the press base 26 (while attached to the press 100) is inserted into the first and second retainer clips; and the clip fasteners are tightened.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A quick release press mount comprising:

a first retainer clip and a second retainer clip, each said retainer clip including a fastening leg, a clamping leg and a retention leg, said fastening leg extending outward from one end of said retention leg, said clamping leg extending outward from the other end of said retention leg in an opposite direction, at least one opening being formed through said fastening leg;

a press base having a thickness that is slightly greater than a height from a bottom of said clamping leg to a bottom of said fastening leg, said press base being attached to a press; and at least one clip fastener being inserted through said at least one opening, said at least one clip fastener being threaded into a support surface, said at least one clip fastener being turned to secure or remove the press from the support surface.

2. The quick release press mount of claim 1, further comprising:

said first and second retainer clips being attached to a clip base, said clip base being attached to the support surface.

3. The quick release press mount of claim 1, further comprising:

said first and second retainer clips being attached to a clip base, said clip base including a riser block and a pair of opposing flanges extending from a bottom of said riser block.

4. The quick release press mount of claim 1, further comprising:

at least one dowel being used to prevent pivoting of said first and second retaining clips.

5. The quick release press mount of claim 1, further comprising:

said press base having a substantially trapezoidal shape, said first and second retainer clips being positioned to receive said press base.

6. The quick release press mount of claim 1, further comprising:

said support surface being a bench.

7. A quick release press mount comprising:

a first retainer clip and a second retainer clip, at least one opening being formed through each said retainer clip;

a clip base being attached to a support surface;

a press base having a thickness that is slightly greater than an inside height of each said retainer clip, said press base being attached to a press; and at least one clip fastener being inserted through said at least one opening, said at least one clip fastener being threaded into said clip base, said at least one clip fastener being turned to secure or remove the press from the press base.

8. The quick release press mount of claim 7, further comprising:

each said retainer clip including a fastening leg, a clamping leg and a retention leg, said fastening leg extending outward from one end of said retention leg, said clamping leg extending outward from the other end of said retention leg in an opposite direction.

9. The quick release press mount of claim 7, further comprising:

at least one dowel being used to prevent pivoting of said first and second retaining clips.

10. The quick release press mount of claim 7, further comprising:

said press base having a substantially trapezoidal shape, said first and second retainer clips being positioned to receive said press base.

11. The quick release press mount of claim 7, further comprising:

said clip base including a riser block and a pair of opposing flanges extending from a bottom of said riser block.

12. The quick release press mount of claim 7, further comprising:

said support surface being a bench.

13. A quick release press mount comprising:

a first retainer clip and a second retainer clip, at least one opening being formed through each said retainer clip;

a clip base being attached to a support surface;

a press base having a thickness that is slightly greater than an inside height of each said retainer clip, said press base being attached to a press; and at least one clip fastener being inserted through said at least at one opening, said at least one clip fastener being threaded into said clip base, said at least one fastener being turned to secure or remove the press from the support surface without removing said at least one clip fastener from said press base.

14. The quick release press mount of claim 13, further comprising:

each said retainer clip including a fastening leg, a clamping leg and a retention leg, said fastening leg extending outward from one end of said retention leg, said clamping leg extending outward from the other end of said retention leg in an opposite direction.

15. The quick release press mount of claim 13, further comprising:

at least one dowel being used to prevent pivoting of said first and second retaining clips.

16. The quick release press mount of claim 13, further comprising:

said clip base including a riser block and a pair of opposing flanges extending from a bottom of said riser block.

17. The quick release press mount of claim 13, further comprising:

said press base having a substantially trapezoidal shape, said first and second retainer clips being positioned to receive said press base.

18. The quick release press mount of claim 13, further comprising:

said support surface being a bench.

* * * * *